US005857222A

United States Patent [19]

Keys

[11] Patent Number: 5,857,222

[45] Date of Patent: Jan. 12, 1999

[54] REMOVAL OF ODORS FROM TOILETS

[75] Inventor: Kenneth John Keys, Leederville, Australia

[73] Assignee: O.T.T. (Australia) Pty Ltd, Leederville, Australia

[21] Appl. No.: 776,712

[22] PCT Filed: Aug. 11, 1995

[86] PCT No.: PCT/AU95/00484

§ 371 Date: Feb. 12, 1997

§ 102(e) Date: Feb. 12, 1997

[87] PCT Pub. No.: WO96/05380

PCT Pub. Date: Feb. 22, 1996

[30] Foreign Application Priority Data

Aug. 12, 1994 [AU] Australia ..... PM7464

[51] Int. Cl.[6] ..... E03D 9/05

[52] U.S. Cl. ..... 4/213; 4/217

[58] Field of Search ..... 4/213, 214, 216, 4/217, 348

[56] References Cited

U.S. PATENT DOCUMENTS

| | | | |
|---|---|---|---|
| 1,590,345 | 6/1926 | Clarke et al. . | |
| 1,614,622 | 1/1927 | Mahnken | 4/213 |
| 1,666,465 | 4/1928 | Norris . | |
| 2,216,008 | 9/1940 | Heuacker . | |
| 2,320,065 | 5/1943 | Briscoe et al. . | |
| 2,322,515 | 6/1943 | Hazard | 4/213 |
| 2,456,534 | 12/1948 | Riedele . | |
| 2,726,405 | 12/1955 | Smith et al. . | |
| 2,824,313 | 2/1958 | Bulow | 4/213 |
| 3,020,564 | 2/1962 | Chedacki et al. . | |
| 4,175,293 | 11/1979 | Stephens et al. | 4/213 |
| 4,876,748 | 10/1989 | Chun | 4/213 |
| 5,253,371 | 10/1993 | Slawinski | 4/213 |

FOREIGN PATENT DOCUMENTS

| | | |
|---|---|---|
| 5172359 | 8/1959 | Australia . |
| 4695185 | 9/1985 | Australia . |
| 2709318 | 8/1993 | France . |
| 2030719 | 7/1971 | Germany . |
| 493200 | 3/1938 | United Kingdom . |
| 1182567 | 4/1968 | United Kingdom . |
| 2247255 | 7/1991 | United Kingdom . |

*Primary Examiner*—Charles R. Eloshway
*Attorney, Agent, or Firm*—Kerkam, Stowell, Kondracki & Clarke, P.C.; Edward J. Kondracki

[57] ABSTRACT

An apparatus for removal of odours from a toilet comprises a vacuum motor and a hose connected to the interior of a toilet pan. The toilet seat includes a hinge comprising a central hollow duct (102) provided with apertures (132) which face the toilet plan for removal of odours therefrom. The odours are sucked from the toilet through the duct and hose and through a vacuum motor assembly and expelled through an outlet in the vacuum motor assembly.

9 Claims, 8 Drawing Sheets

REMOVAL OF ODORS FROM TOILETS

DESCRIPTION

The present invention relates to an apparatus for removal of odours from a toilet.

SUMMARY OF THE INVENTION

In accordance with one aspect of the present invention there is provided a toilet seat hinge characterised in that it comprises a hollow duct containing one or more apertures arranged to face towards a toilet pan, the duct being arranged to be connected to a vacuum motor for removal of odours.

In accordance with a further aspect of the present invention there is provided an apparatus for removal of odours from a toilet characterised in that it comprises a vacuum motor and means arranged to connect the vacuum motor to an interior of a toilet pan.

BRIEF DESCRIPTION OF THE DRAWINGS

The present invention will now be described, by way of example, with reference to the accompanying drawings, in which.

DESCRIPTION OF THE INVENTION

Figure 1:
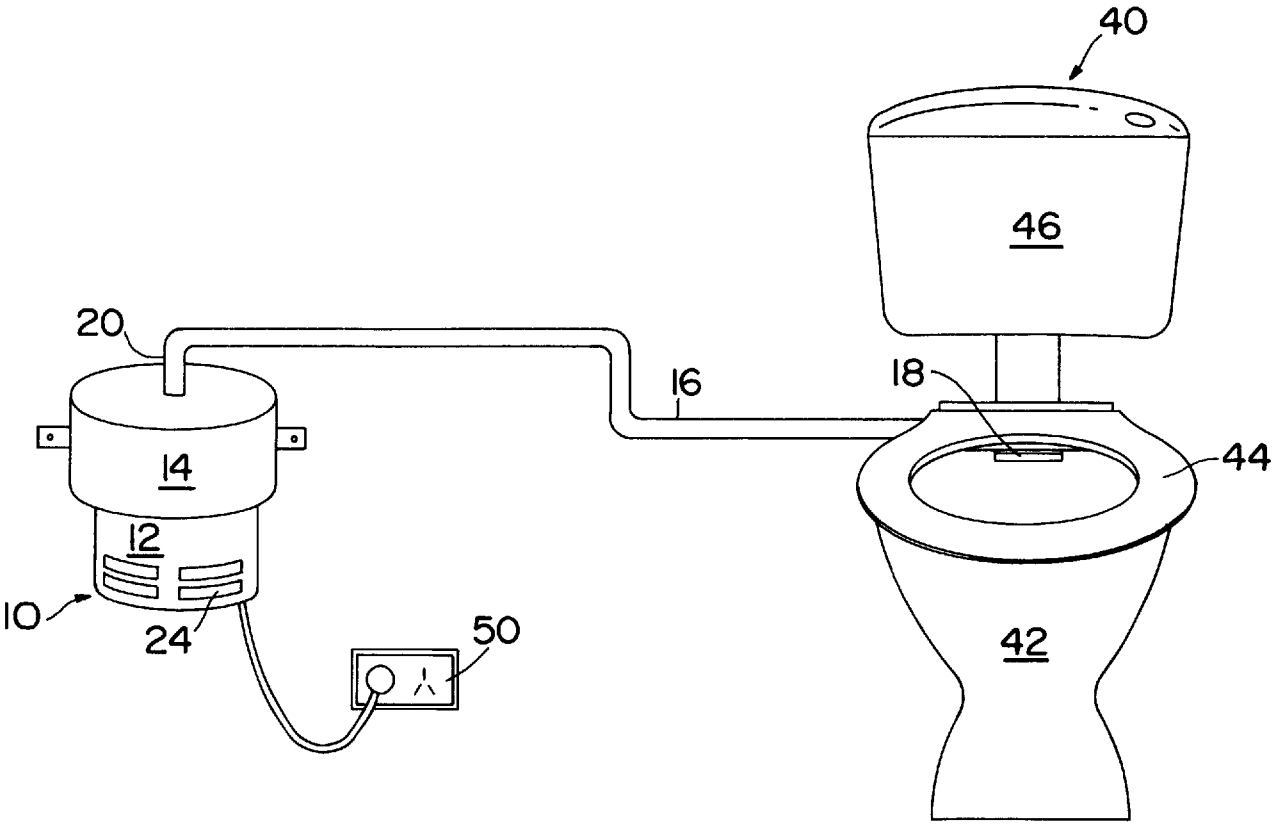
FIG. 1 is a front perspective view of an apparatus for removal of odours from a toilet in accordance with the present invention installed internally.
Figure 2:
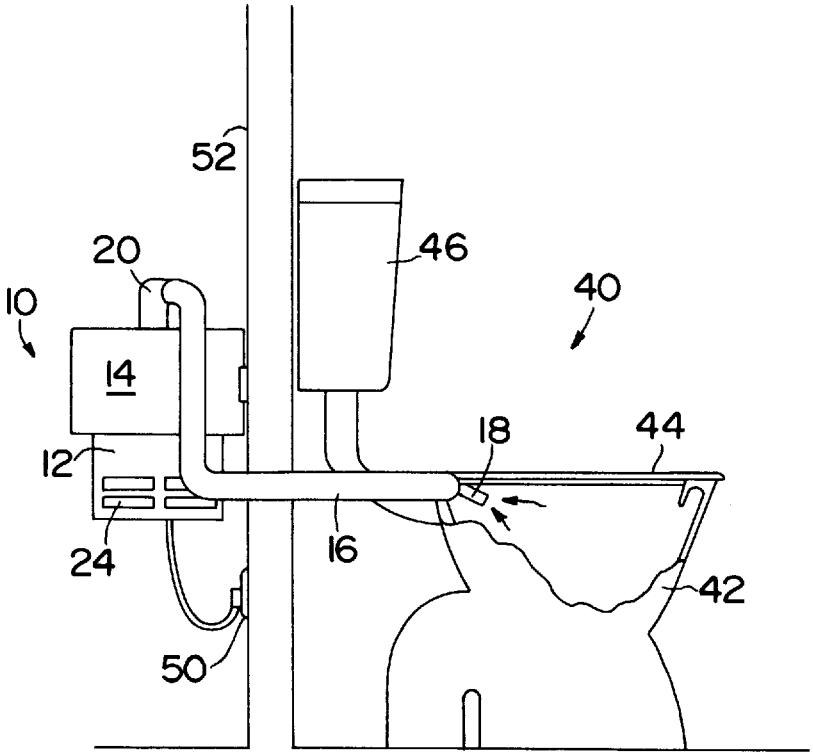
FIG. 2 is a side elevation of an apparatus for removal of odours from a toilet in accordance with the present invention installed externally.
Figure 3:
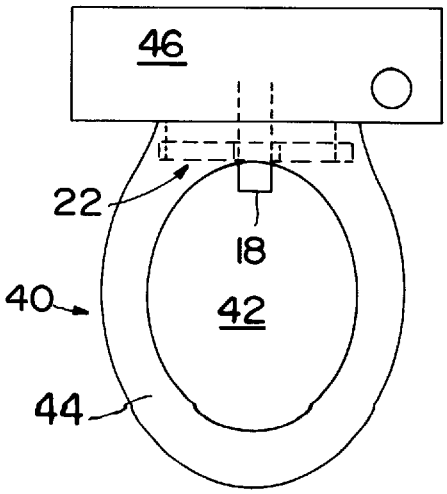
FIG. 3 is a plan view of the apparatus of FIG. 2 showing positioning of a hose.

In FIGS. 1 to 6 of the accompanying drawings there is shown an apparatus 10 for removal of odours from a toilet comprising a vacuum motor 12, a filter 14, a hose 16 having a first end 18 and a second end 20, and a switch 22 (see FIG. 3). There is also shown in FIGS. 1 to 3 a toilet 40 comprising a toilet pan or bowl 42, a seat 44 and a cistern 46. Further, there is shown a mains power point 50 from which power for the vacuum motor 12 is supplied. The first end 18 of the hose 16 extends under the seat 44 and into the bowl 42 of the toilet 40. The second end 20 of the hose 16 connects to the filter 14. The vacuum motor 12 is mounted below the filter 14 in communication therewith.

When the vacuum motor 12 is operated, a vacuum is created in the hose 16 such that air is drawn into the first end 18 of the hose 16 from the bowl 42 of the toilet 40, thereby drawing unwanted odours into the hose 16. Air from the hose 16 enters the filter 14 via the second end 20 of the hose 16. The vacuum motor 12 draws the air from the hose 16 through the filter 14 and the filtered air is released through a number of outlets 24 located in a peripheral wall of the vacuum motor 12.

Shown in FIG. 1 of the accompanying drawings is an embodiment of the present invention in which the apparatus 10 has been installed internally within a room. In this embodiment, the filter 14 and the vacuum motor 12 are located within the room which contains the toilet 40. Further, it is envisaged that a fragrant substance or scented filtration layer may be inserted into the filter 14 to deodorise and filter simultaneously the air.

In FIG. 2 of the accompanying drawings, there is shown an embodiment of the present invention in which the filter 14 and the motor 12 are located externally. Like reference numerals to those used in FIG. 1 are used for corresponding components of the apparatus of FIG. 2. The filter 14 and motor 12 are mounted on the outside of a wall 52 whilst the toilet 40 is located on the inside of the wall 52. The pipe 16 extends through the wall 52. This embodiment may be particularly useful where noise in the motor 12 is a major factor, or where it is simply desired to have the filter 14 and the motor 12 outside for aesthetic reasons.

In FIG. 3 of the accompanying drawings there is shown some details of the toilet 40. In FIG. 3, the positioning of the first end 18 of the hose 16 can be seen. Also shown in FIG. 3 is a switch 22 located under the seat 44. Preferably, the switch 22 is a pressure sensitive switch which is arranged to activate when the seat 44 is lowered and a weight is applied to the seat 44, for example when a person is sat on the seat 44. Thus, the switch 22 is preferably arranged not to activate the motor 12 when the seat 44 is in a lowered position but no weight is applied to it, or alternatively if the seat 44 is simply allowed to fall from the raised to the lowered position. By making the switch 22 pressure sensitive wear on the motor 12 can be reduced. A rapid number of startings and stoppings of the motor 12 due to the seat 44 falling from the raised to the lowered position is undesirable as it may lead to increased wear on the motor 12. Further, it is envisaged that the switch 22 may be a standard switch installed in a room. For example, many houses have extraction fans which activate when a light is turned on and it is envisaged that the apparatus 10 might be activated in a similar manner.

Figure 4:
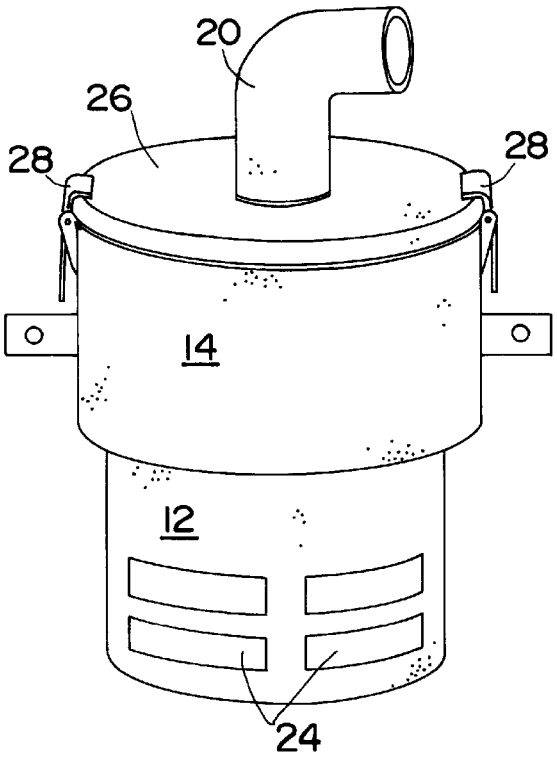
FIG. 4 is a front elevation of an arrangement of a filter and a motor for use in the present invention.

In FIG. 4, details of the filter 14 and the motor 12 can be seen. The second end 20 of the hose 16 connects to a lid 26 of the filter 14. The lid 26 is held in place by a pair of clips 28. The lid 26 can be removed by releasing the clips 28, providing access to filter material within the filter 14. Thus, the clips 28 and the lid 26 provide a mechanism for regular maintenance of the filter 14 and also allow insertion of deodorising materials if desired.

Figure 5:
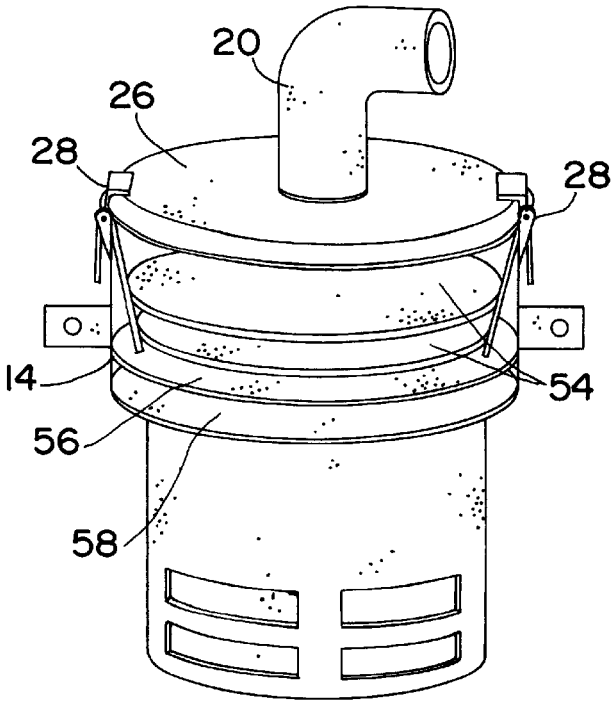
FIG. 5 is a view similar to FIG. 4 showing internal details of the filter shown in FIG. 4.

FIG. 5 shows further details of the filter 14 with internal details of the filter 14 shown As can be seen from FIG. 5, the filter 12 includes therein a pair of purification agents 54, a first filter 56 and a second filter 58.

The purification agents 54 can be of any known type, for example a carbon purification agent. Further, the first filter 56 can be a urethane filter, whilst the second filter 58 may also be a urethane filter or a filter formed of another foam material. By providing a number of filtration media, air passing through the filter 14 is effectively filtered for unwanted odours, as well as undesirable bacteria. In addition, it is envisaged that an air deodorising agent may be added into the filter 14. For example, one of the carbon purification agents 54 may be replaced with a deodorising agent. Alternatively, a deodorising agent may be added in a fifth filter.

Figure 6:
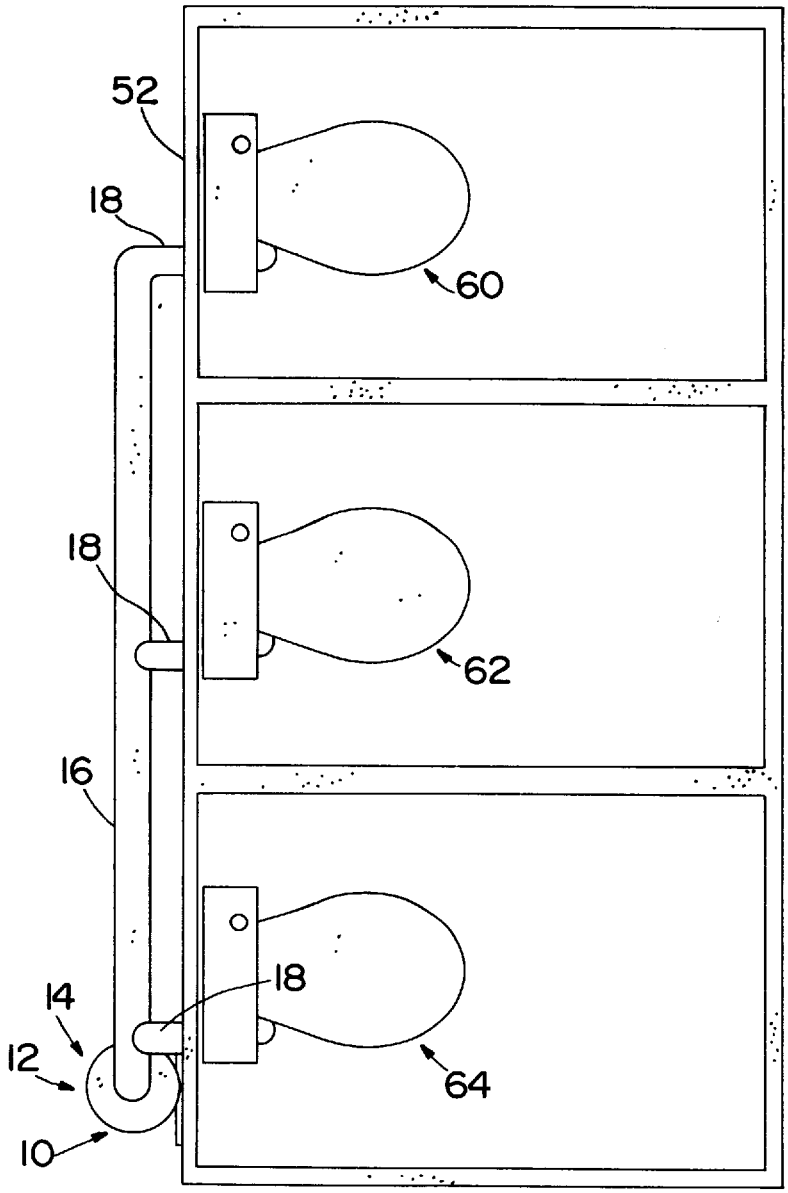
FIG. 6 shows an apparatus in accordance with the present invention servicing multiple toilets.

In FIG. 6 of the drawings is shown the apparatus 10 in an arrangement to provide deodorisation for more than one toilet. For example, in public toilets there is typically provided a number of toilets and it would be desirable for a single apparatus 10 to service multiple toilets. Shown in FIG. 6 is an externally located apparatus 10 servicing a number of toilets 60, 62 and 64. It has been found that a single apparatus 10 is capable of deodorising up to three toilets. Further, it has been found that two apparatuses 10 are sufficient to service eight toilets.

As can be seen from FIG. 6, only one of each of the motor 12 and the filter 14 is required to service the toilets 60, 62 and 64. The hose 16 connects to the filter 14 and to each of the toilets 60, 62 and 64 via respective first ends 18.

Each of the toilets 60, 62 and 64 includes a switch. When the switch of any of the toilets 60, 62 or 64 is switched on, the apparatus 10 is activated and removal of odours then proceeds. Since the hose 16 connects to all of the toilets 60, 62 and 64, whenever any one of the toilets 60, 62 or 64 are activated, then all of the toilets 60, 62 and 64 have odours removed therefrom. However, since only one motor 12 is required, there is no additional power required to remove odour from the three toilets 60, 62 and 64.

FIGS. 7 to 11 of the accompanying drawings, there is shown a toilet seat hinge 100 according to a further embodiment of the present invention arranged particularly to be used as part of an odour removal apparatus of the present invention.

Figure 11:
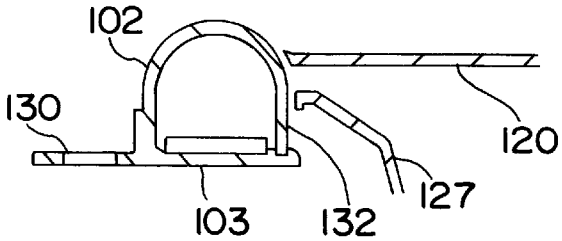
FIG. 11 is a section along the line 11—11 of FIG. 7.

The hinge 100 comprises a central elongated hollow duct 102 of arched shape in cross-section having a flat base 103 (see FIG. 11).

Attached to the duct 102 on one side thereof is a tubular member 104 which is of generally circular cross section and of smaller external dimension than the duct 102. Further, attached to the duct 102 on another side thereof is a further tubular member 106 which is also generally circular in cross section and of smaller external dimension than the duct 102.

The tubular member 106 has an intermediate step 108 such that the portion 110 thereof remote from the duct 102 is of smaller external dimension than the portion 112 adjacent the duct 102.

Further, an L-shaped coupling member 114 has one leg 116 mounted about and coupled to the portion 110. Another leg 118 of the coupling member 114 is arranged to be coupled to a hose (not shown).

Figure 7:
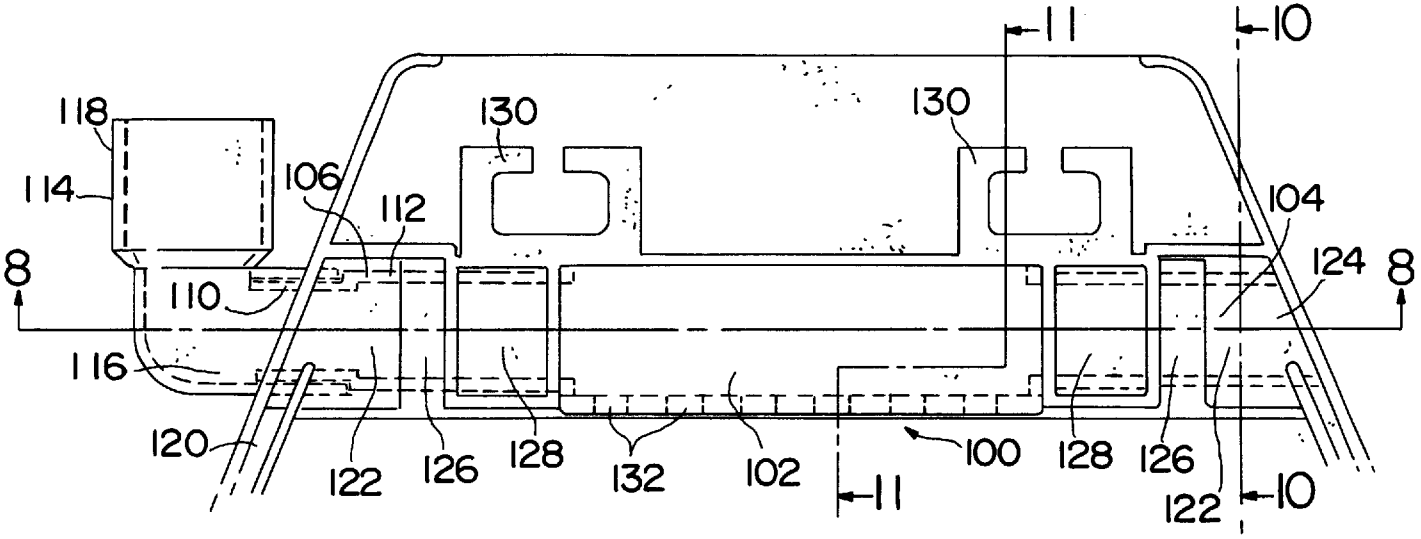
FIG. 7 is a plan view of a toilet seat hinge in accordance with a further embodiment of the present invention.

As shown in FIG. 7, a toilet lid 120 is connected to the toilet seat hinge 100. The lid 120 is connected to the toilet seat hinge 100 by means of a pair of rings 122 which are located along a rear edge of the lid 120, are integrally formed with the lid 120 and are disposed at outer ends of the rear edge. One of the rings 122 is mounted about the tubular member 104 and the other ring 122 is mounted about the tubular member 106 (as can best be seen in FIG. 10).

The rings 122 are a relatively loose fit on the tubular members 104 and 106 so that the lid 120 can be pivoted about the toilet seat hinge 100 on the rings 122 from a raised position to a lowered position in known manner.

Figure 8:
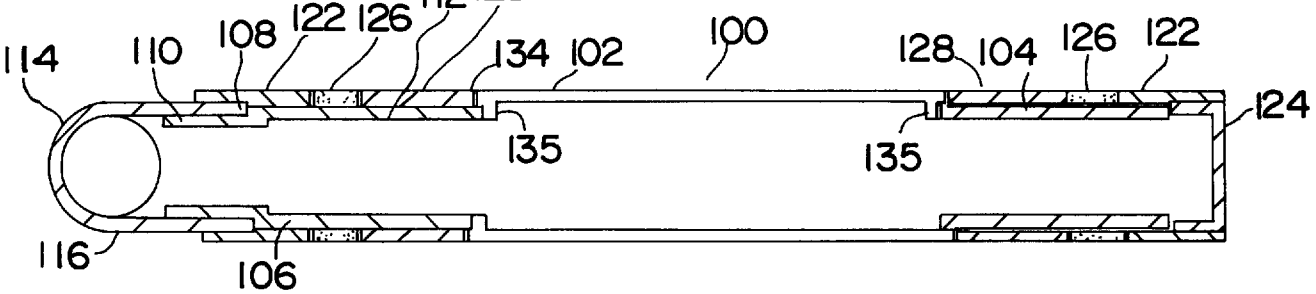
FIG. 8 is a section taken along the line 8—8 of FIG. 7.

Further, as shown in FIG. 8, mounted within the ring 122 which is mounted about the tubular member 104 is an end plug 124. The end plug 124 is non rotatably mounted and closes off an end of the duct 102.

Still further, a pair of spaced annular collars 126 are rotatably mounted about the tubular members 104 and 106 respectively. The collars 126 are mounted inboard of the rings 122. The collars 126 are integrally connected to a rear edge of a toilet seat 127 (see FIGS. 10 and 11). The rotatable mounting of the collars 126 relative to the seat hinge 100 enables the toilet seat 127 to be pivoted between a raised position and a lowered position. Further, annular members 128 are non-rotatably mounted about the tubular members 104 and 106 inboard of the collars 126. The annular members 128 are a relatively tight fit on the tubular members 104 and 106 and are not arranged for rotational movement. Further, a respective lug member 130 projects rearwardly from each of annular members 128. The lug members 130 are of known type and are arranged for receipt of securing bolts which secure the hinge 100 to a toilet pan in known manner.

Figure 9:
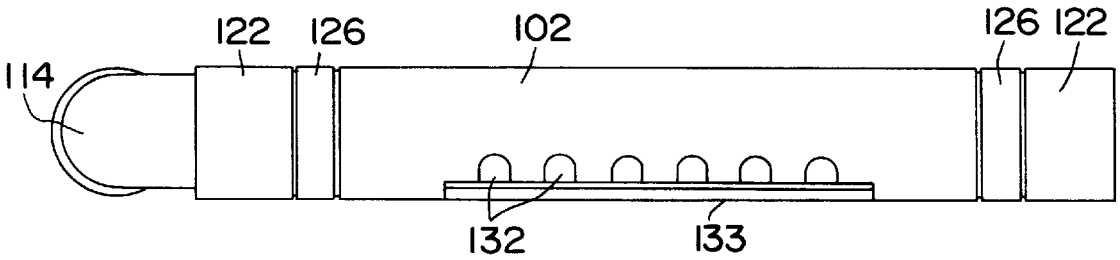
FIG. 9 is a front elevation of the toilet seat hinge of FIG. 7 with a toilet lid and a toilet seat-removed.
Figure 10:
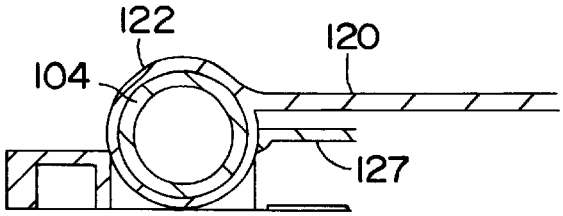
FIG. 10 is a section along the line 10—10 of FIG. 7.

As can best be seen in FIGS. 9 and 11, the duct 102 contains a row of apertures 132 which face into the toilet pan below the level of the toilet seat 127. Further, the base 103 contains a portion 133 which is hingedly connected by any suitable means to the remainder of the base 103. The hinged portion 103 can then be hinged away from the remainder of the base 103 to enable the tubular members 104 and 106 to be inserted in the duct 102 and to project through the annular members 128 to engage with a respective ring 122 and collar 126. Further, each tubular member 104 and 106 has an inner outwardly extending flange 134 which engages with an inner end of the respective annular member 128 to prevent the tubular members 104 and 106 being inadvertently removed longitudinally outwardly from the duct 102. Also, the duct 102 has adjacent each end thereof a lug 135 which engages with the adjacent inner end of a respective tubular member 104 and 106 to prevent the tubular members 104 and 106 being displaced inadvertently inwardly into the duct 102. Once the tubular members 104 and 106 are in place the hinged portion 133 is closed so that the entire base 103 is flat. Preferably, means is provided for retaining the hinged portion 133 in the closed position. Further, the hinge 133 is attached to the remainder of the apparatus by means of a cut away notch portion 136 which enables the hinged portion 133 to be pivoted between open and closed positions.

Further it is envisaged that the hinged portion 133 could be replaced by a separate detachble base which could be removed in its entirety for insertion of the tubular members 104 and 106 and then clipped in flush with the base 103.

The L-shaped coupling member is, in use, connected to a hose by means of the leg 118 as described above. The hose is connected to a vacuum motor as described hereinabove in relation to FIGS. 1 to 6.

Figure 12:
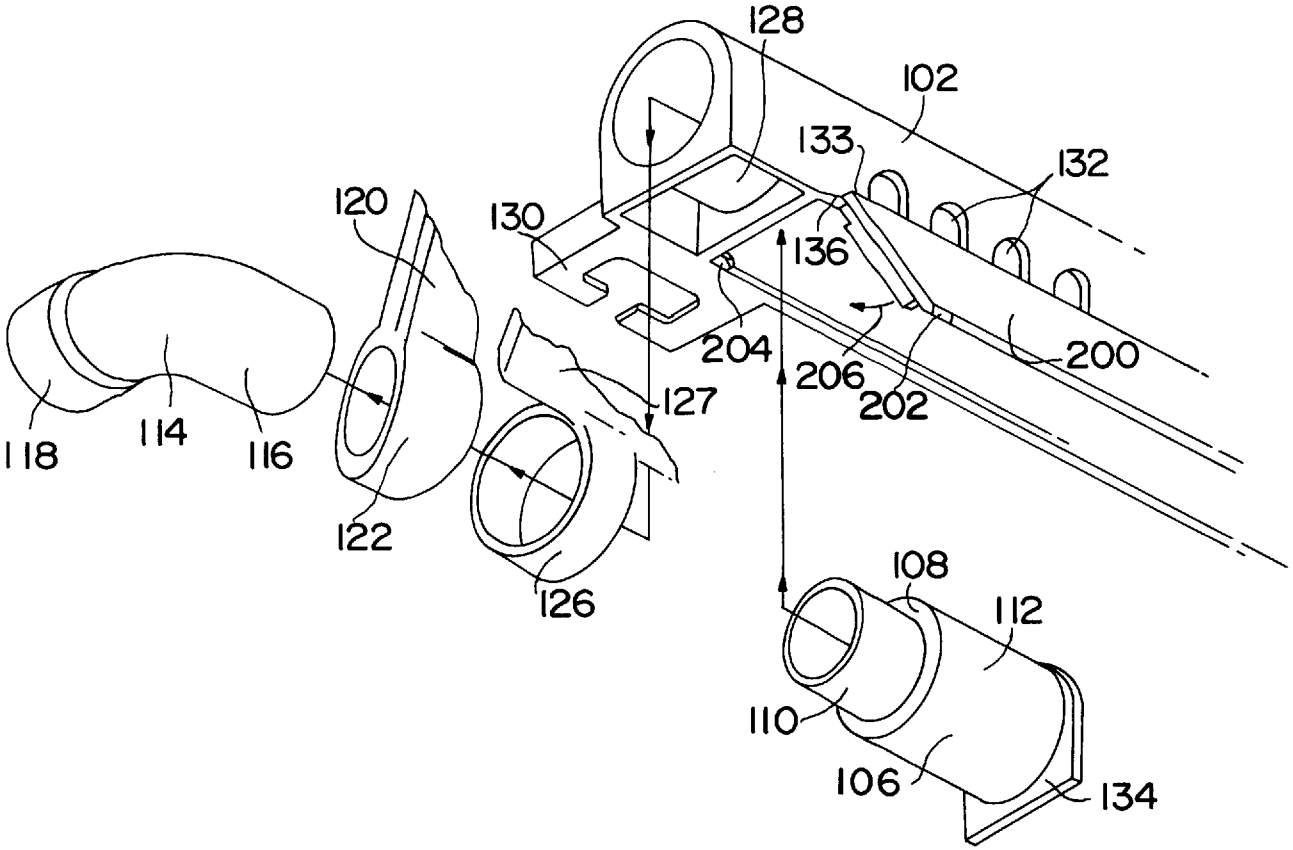
FIG. 12 is an exploded underneath perspective view of part of modified form of toilet seat hinge in accordance with the present invention.

A modified form of the hinge 100 is shown in FIG. 12. In FIG. 12 there is shown a hinge 200. Like reference numerals are used to denote like parts to those found in FIGS. 7 to 11.

In the embodiment of FIG. 12 the arched shape of the duct 102 is extended so as to enclose the annular member 128. Further, the hinged portion 133 includes a resilient catch 202 which engages with an aperture 204 in the duct 102 when the hinged portion is hinged in the direction indicated by the arrow 206 to a closed position. The recess 204 extends right through a wall of the duct 102 so that the catch 202 can be accessed externally if necessary to release the catch 202 to enable the hinged portion 133 to be hinged to the open portion shown in FIG. 12.

In operation, the vacuum motor 12 is activated and this causes a substantial drop in pressure in the hose 16, the L-shaped elbow 114, the tubular members 104 and 106 and the duct 102. Thus, air is drawn from the toilet pan through the apertures 132 in the duct 102 and then through the vacuum motor as described hereinabove in relation to FIGS. 1 to 6. In this way, odours are quickly and efficiently withdrawn from the toilet pan and nullified.

Further, the toilet lid 120 can be rotated between raised and lowered positions on the rings 122 and the toilet seat 127 can be rotated between raised and lowered positions on the collars 126 in known manner.

Figure 13:
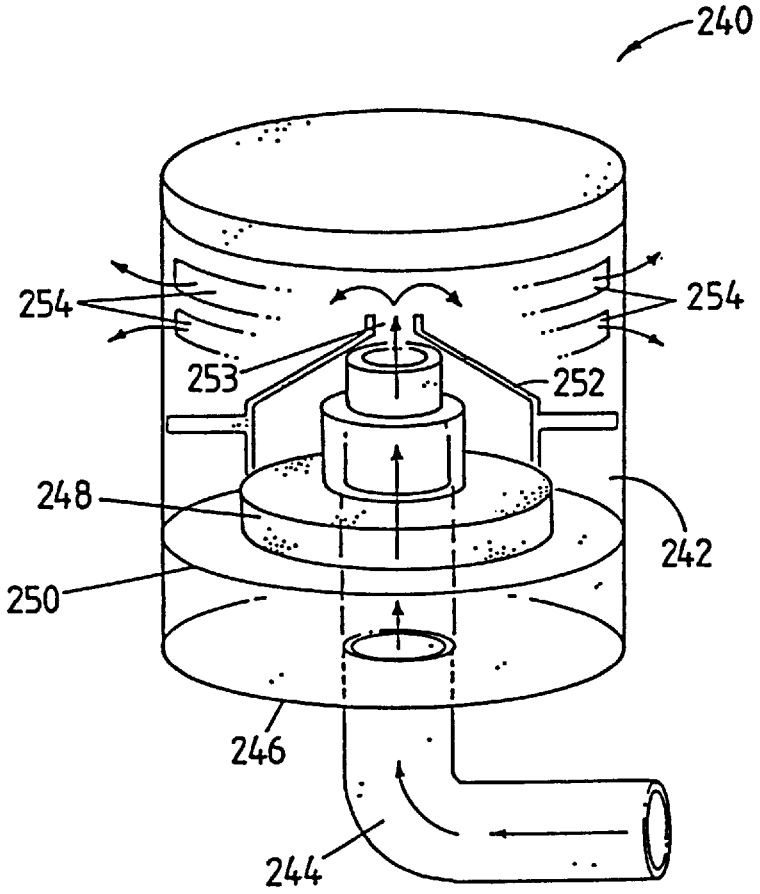
FIG. 13 is a schematic perspective view of a vacuum motor used in the present invention showing the internal arrangement thereof.

A typical construction for a vacuum motor assembly 240 is shown in FIG. 13. In FIG. 13 there is shown a housing 242 having an inlet conduit 244 at a lower end 246 thereof. A vacuum motor 248 is mounted within the housing 242 on a platform 250. The conduit 244 extends upwardly through the platform 250 and the vacuum motor 248.

A shroud 252 is mounted above the vacuum motor 248. The shroud has an outlet 253. The housing 242 contains air outlets 254.

In operation, the vacuum motor 248 is activated which causes air to be withdrawn from the inlet conduit 244 at a rate sufficient to cause the pressure therein to fall below atmospheric pressure. Thus, where the conduit 244 is connected to a toilet bowl as described herein, odours from the toilet bowl are drawn into the conduit rapidly so removing the odours efficiently from the toilet bowl.

The air in the conduit 244 is drawn through the vacuum motor 248 and then through the outlet 253 in the shroud 252. The withdrawn air is expelled through the outlets 254. It is typically found that heat generated by the vacuum motor is sufficient to destroy odours in the air so that the air expelled through the outlets 254 is substantially odour free. Further, it has been found that as the expelled air is substantially odour free it is possible to dispense with filtration of the air.

Modifications and variations such as would be apparent to a skilled addressee are deemed within the scope of the present invention.

I claim:

1. A toilet seat hinge assembly for removing odours from a toilet pan and for mounting a toilet seat and lid assembly on an upper rear surface of the toilet pan, said toilet seat and lid assembly adapted to be rotated between a raised and a lowered position, characterized in that said hinge assembly comprises a hollow duct having opposed ends and containing therebetween at least one aperture arranged to face towards the toilet pan, means connecting the duct to a vacuum motor assembly adapted upon activation to effect removal of odours from the toilet pan, said vacuum motor assembly comprising a housing having an inlet conduit and air outlet means and a vacuum motor mounted within the housing, the inlet conduit extending to the vacuum motor and the air outlet means being disposed such that, in use, air is drawn from the toilet through the hinge assembly and through the inlet conduit by the vacuum motor, the drawn air thereby passing through the vacuum motor and being expelled through the air outlet means in the housing, an outwardly projecting tubular member mounted at each end of the duct, said tubular member being generally circular in cross section, and the duct including a base containing an aperture normally closed by a moveable member, the moveable member being hingedly attached to the base of the duct and arranged to be moved to an open position, such that each tubular member can be passed through the base aperture and then through a respective end of the duct to project outwardly therefrom.

2. A toilet seat hinge assembly according to claim 1, characterized in that the toilet lid of the toilet seat and lid assembly is adapted to be connected to the hinge assembly by means of spaced rings which are connected to the toilet lid and which are rotatably mounted about respective tubular members, the toilet lid being rotatable between a raised position and a lowered position.

3. A toilet seat hinge assembly according to claim 2, characterized in that the toilet seat is adapted to be connected to the hinge assembly by means of spaced collars which are connected to the toilet seat and which are rotatably mounted about the respective tubular members.

4. A toilet seat hinge assembly according to claim 3, characterized in that the hollow duct contains a plurality of apertures.

5. A toilet seat hinge assembly according to claim 2, characterized in that the hollow duct contains a plurality of apertures.

6. A toilet seat hinge assembly according to claim 1, characterized in that the hollow duct contains a plurality of apertures.

7. A toilet seat hinge assembly according to claim 1, characterized in that each tubular member has an outwardly extending inner flange to retain the tubular member in place in the duct.

8. A toilet seat hinge assembly according to claim 1, further including a coupling member mounted in an outer end of one of the two projecting tubular members and arranged to be connected to a hose.

9. A toilet seat hinge assembly according to claim 8, characterized in that an end plug is inserted in an outer end of the other of the two projecting tubular members.

* * * * *